United States Patent [19]

Demirel et al.

[11] Patent Number: 5,066,943

[45] Date of Patent: Nov. 19, 1991

[54] PATENT MONITORING SYSTEM

[76] Inventors: Osman S. Demirel, 21729 Cypress Way; John D. Sanwick, 21026 22nd Ave. W., both of Lynnwood, Wash. 98036

[21] Appl. No.: 619,226

[22] Filed: Nov. 28, 1990

[51] Int. Cl.[5] ..... G08B 23/00

[52] U.S. Cl. ..... 340/573; 340/692

[58] Field of Search ..... 340/573, 692, 407, 825.19, 340/548, 287, 297-298; 200/61.19; 24/545, 561-562

[56] References Cited

U.S. PATENT DOCUMENTS

| | | | |
|---|---|---|---|
| 4,117,461 | 9/1978 | Kiebala | 340/692 X |
| 4,297,677 | 10/1981 | Lewis et al. | 340/825.19 X |
| 4,300,129 | 11/1981 | Cataldo | 340/407 X |
| 4,577,185 | 3/1986 | Anderson | 340/573 |
| 4,583,084 | 4/1986 | Henderson et al. | 340/573 |
| 4,616,113 | 10/1986 | Jank et al. | 200/61.19 X |
| 4,709,330 | 11/1987 | Yokoi et al. | 340/573 X |
| 4,810,996 | 3/1989 | Glen et al. | 340/692 X |
| 4,951,045 | 8/1990 | Knapp et al. | 340/573 X |

*Primary Examiner*—Glen R. Swann, III
*Assistant Examiner*—Thomas J. Mullen, Jr.
*Attorney, Agent, or Firm*—Cassidy, Vance & Tarleton

[57] ABSTRACT

A patient monitoring system (10) having a battery (14) and an audible message device (16) mounted in a housing (12) and electronically connected to a clip (18) that attaches to a patient's clothing (100). A connector strap (20) attaches the housing (12) to a clamp (22) such that movement of the patient beyond the range of the strap (20) causes the clip (18) to be removed from the clothing (100) and bring electrical contacts (32 and 34) into contact to activate the device (16). The connector strap (20) has a buckle (38) to permit adjustment in the length of the strap to alter the range of movement of the patient.

21 Claims, 2 Drawing Sheets

PATENT MONITORING SYSTEM

TECHNICAL FIELD

The present invention pertains to patient and medical device monitoring systems and, more particularly, to a system for warning a health care provider of a changed condition and concurrently informing the patient, which may include instructing, orienting, and/or communicating any other desirable information, and calming the patient as well as informing the caregiver of a condition requiring their awareness.

BACKGROUND OF THE INVENTION

Frequently, patients in nursing homes and hospitals must be monitored when personnel are not present. For instance, patients receiving intravenous injection are left unattended because staff and personnel are needed elsewhere. Typically, the intravenous delivery device is monitored so that when the intravenous solution is depleted, an alarm is sounded to alert the caregiver of this condition. Because most patients are unfamiliar with these devices, the sounding of the alarm can scare the patient and cause them to be frightened and uneasy.

Patients in nursing homes and hospitals must also be monitored when they move about or require assistance when they attempt to sit, stand, and walk. In the past, these patients have had to be immobilized with physical restraints when personnel have not been available to assist or watch them. The use of physical restraints, such as straps and cords, has been found unsuitable in many cases because it is objectionable to the patient and the patient's relatives, and it often results in unnecessary discomfort for the patient.

Several alternative systems have been proposed for notifying a caregiver that a patient is attempting to move. For instance, in U.S. Pat. No. 2,260,715, a normally closed contact switch is placed between the mattress and the box spring on the patient's bed. The weight of the patient in the bed opens the contact switch to prevent activation of an electric light. When the weight of the patient is removed from the bed, the contact switch closes to activate the electric light. If applied to alarms, this system would have the disadvantage of being subject to frequent false alarms, such as when the patient momentarily lifts a significant portion of his weight off the bed to shift position, or when the patient moves to merely sit on the edge of the bed. This system also requires modification of the bed mattresses to insert the contact switch and wires and to insulate the electronic components to minimize the risk of fire, personal injury, and shock.

In U.S. Pat. No. 4,577,185, an alert system is disclosed that uses a built-in call unit or alarm in the wall and a cord having one end plugged into the wall unit and the other end clipped to the patient's clothing. With the cord plugged into the call unit, the alarm is deactivated. As the patient attempts to sit up or move, the attached cord is pulled from the call unit to activate the alarm. This particular system requires that the call unit be horizontally and vertically aligned with the patient to allow the plug to be easily removed from the wall unit. Any misalignment of the cord with the axis of the plug will make it extremely difficult to pull the plug from the call unit and may result in the cord pulled from the patient's clothing. This would render the alarm ineffective and allow the patient to get up. As such, this system is limited to use in a hospital bed. Furthermore, this system requires modification of the wall of the care facility and, if a standard wall-mounted monitor is used, the existing patient call button must be replaced by the alarm cord, which introduces a significant problem.

Another drawback to these systems and to the alarm system used on intravenous solution delivery devices and other devices which require alerting the caregiver of certain conditions is that the sounding of an alarm can easily frighten a patient. This is especially true when a patient is awakening from sleep in a room where the caregiver is not present. When the patient awakens, he can be disoriented and experience apprehension if he is unfamiliar with his surroundings or forgets where he is. The sounding of an alarm will create fear and additional concern in the patient. This can cause the patient to become overly excited and cause harm to himself or others or damage to the facilities. Consequently, there is a need for a monitoring system that will inform, calm, etc., the patient as well as inform the caregiver as to a change in conditions, such as the need to replenish intravenous solution or to attend to a patient who is attempting to move.

SUMMARY OF THE INVENTION

The present invention is directed to a patient monitoring system for alerting a health care provider of changed conditions and informing and calming a patient. The system comprises an audible message device, a switch that removably attaches to a patient's clothing and activates the alarm when the switch is removed from the patient's clothing, and a tethered connector for connecting the switch to an anchor member such that movement of the patient a predetermined distance away from the anchor member causes the switch to be removed from the patient's clothing to thereby activate the audible message device.

In accordance with another aspect of the present invention, the switch comprises a pair of jaw members resiliently biased to close into contact with each other to permit the switch to be attached to and removed from the patient's clothing. The jaw members include electrical contacts that are in contact when the jaw members are closed to activate the audible message device and are not in contact when the switch is attached to a patient's clothing, thereby deactivating the audible message device.

In accordance with an alternative embodiment of the present invention, the system comprises a housing having a self-contained source of electrical power and an audible message device mounted therein. A clip is mounted to the housing. The clip has a pair of jaw members resiliently biased to close together to permit attachment of the clip to a patient's clothing. The clip includes a pair of electrical contacts that are connected to the electrical power source and the message device. When the clip is attached to the patient's clothing, the electrical contacts are held apart. When the clip is removed from the patient's clothing, the jaw members are urged closed to bring the electrical contacts into engagement with each other and activate the audible message device.

In accordance with another aspect of the present invention, the connector comprises an electrically conductive wire that connects the jaw members to the anchor and electrically connects the jaw members to the alarm.

In accordance with another aspect of the present invention, the connector comprises a flexible filament attached at one end to a ball and loop and at the other end to the audible message device. The flexible filament is preferably configured to be adjustable in length to permit changing the distance the patient is permitted to move before the audible message device is activated.

In accordance with an alternative embodiment of the present invention, the patient monitoring system comprises an audible message device a prerecorded voice message that informs the patient of a changed condition such that the patient will be calmed and warns the caregiver of the change in condition.

In accordance with an alternative embodiment of the present invention, the patient monitoring system comprises an audible message device, a plug that is removably inserted into the audible message device, a tethered connector for connecting the plug to the patient such that movement of the patient a predetermined distance away from the audible message device causes the plug to be removed from the audible message device, thereby activating the audible message device.

As will be readily appreciated from the foregoing description, the patient monitoring system of the present invention utilizes an audible voice message to inform and calm a patient, hence eliminating the fear and concern that can arise in unfamiliar conditions. This system also replaces the use of restraints for appropriate hospital and nursing home patients. The device is simple to use and requires no modification to existing structural members, such as walls, bed mattresses, etc., required. Because the audible message device will not be activated until the clip is actually removed from the patient's clothing or the plug is pulled from the audible message device, false alarms are significantly reduced. Use of the plug will eliminate the use of the clip and electrical conducting wire associated therewith. In addition, the device is unobtrusive, economical to manufacture and use, and safe because it can be battery operated. Finally, the present invention allows adjustment in the range of movement of the patient and gives greater flexibility to permitted movement, for instance, to permit the patient to stand at the side of the bed without activating the device.

While a preferred embodiment of the invention has been briefly described in the context of patient health care, it is to be understood that the system is useful in other applications without departing from the spirit and scope of the present invention. Not only may the system be directly useful with wheelchairs and beds, it may also be used to monitor the movement of young children and even pets. Furthermore, the invention may be used with inanimate objects that are moved by an outside force. For instance, a door leading to a stairway may be tethered with the warning device such that, when the door is moved by a small child, the warning will instantly sound to alert the patent or a babysitter and prevent the child from falling down the stairs and the voice message will inform and instruct the child. Finally, the present invention can be adapted to add patient communication to an existing device that is concurrently designed to inform the health caregiver of a condition requiring their awareness. Consequently, it is anticipated that the present invention can be used in other applications not specifically described herein.

BRIEF DESCRIPTION OF THE DRAWINGS

The foregoing and other features and advantages of the present invention will be more readily appreciated as the same becomes better understood by reference to the detailed description when taken in conjunction with the accompanying drawings, wherein.

DETAILED DESCRIPTION OF THE PREFERRED EMBODIMENT

Figure 1:
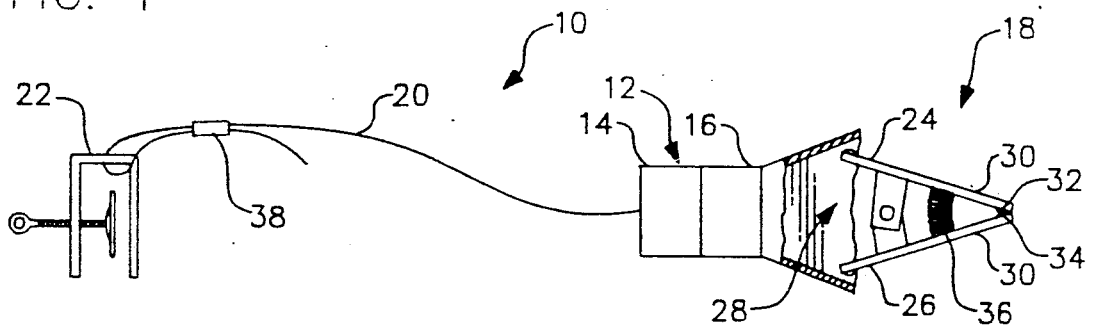
FIG. 1 is a side view of a representative patient monitoring system formed in accordance with the present invention.

Referring initially to FIG. 1, the patient monitoring system 10 includes a housing 12 which contains a battery 14, a warning and audible message device 16, and a switch in the form of a clip 18. A connector strap 20 attaches the housing 12 to a clamp 22.

The device 16 is an electrically powered auditory device or a combination of auditory and visual devices. Preferably, the device 16 utilizes a prerecorded voice messsage system. This system includes a voice message that informs the patient of the changed condition and gives any necessary instructions or reassurance. For instance, when the device 16 is attached to an I.V. solution bottle, depletion of the solution will activate the message which will say: "The I.V. solution is depleted. You are in no danger. Your caregiver will be notified." In addition, low-volume beeps or other mild burst of sound may be inserted between message sentences to attract the attention of a caregiver. The exact content of the message will be determined by the situation or changed condition that is being monitored. Consequently, one of ordinary skill will be able to compose a suitable message to meet the needs of the particular application.

The device 16 may comprise a radio-frequency transmitter that communicates with a nurse's station to activate an audible or visual signal at the nurse's station or the device 16 may be direct-wired to the nurse's station. Typically, a battery 14 is electrically wired to the device 16 to provide a safe, self-contained source of electrical power. The housing 12 is preferably constructed of resilient or elastometric material that permits squeezing and opening of the clip switch 18.

The clip switch 18 consists of a pair of spring-loaded, normally closed jaw members 24 and 26, each having a handle portion 28 and a distal gripping portion 30. As shown in FIG. 1, the handle portion 28 of the jaw members 24 and 26 is enclosed by the resilient housing 12. Each gripping portion 30 has electrical contacts 32 and 34 respectively attached to jaw members 24 and 26. A helical torsion spring 36 resiliently urges the gripping portions 30 of the jaw members 24 and 26 to close such that the electrical contacts 32 and 34 touch each other.

Each contact 32 and 34 is wired to the battery and the alarm device such that when the contacts 32 and 34 touch each other an electric circuit is completed and the alarm 16 is activated. When the clip 18 is squeezed at the handle portions 28, the gripping portion 30 of the jaw member 24 and 26 open and the electric circuit at the contacts 32 and 34 is broken, thereby deactivating the device 16.

The connector strap 20, constructed of suitable material such as belting or plastic, has a buckle 38 near the anchored end for adjusting in the length of the strap to tether the housing closer to or further away from the clamp 22. The clamp 22 is adapted for attachment to a firm anchor point, such as a bed frame, wheelchair, or other heavy object or structural member, such as a wall, door, etc. Although a strap is illustrated and described, it is to be understood that other flexible filaments may be used, such as rope, cordage, woven fabric, etc.

In operation, the clamp 22 is first attached to a suitable anchor point such as the bed frame or back of a wheelchair, etc. The connector strap 20 is then adjusted to a predetermined length to suit the needs of the patient and the health care provider. The clip 18 is then attached to an article of clothing worn by the patient. The placement of clothing 100 shown in FIG. 5 between the jaw members 24 and 26 separates the electrical contacts 32 and 34 to deactivate the device 16. A standard switch may be provided in the electric circuit to prevent arming of the device 16 until after the clip 18 is attached to the patient's clothing. Once the clip 18 is attached and the device 16 is armed, movement of the patient beyond the length of the connector strap 20 will pull the clip 18 from the patient's clothing. The helical torsion spring 36 then forces the jaw members 24 and 26 to close, bringing the contacts 32 and 34 into contact with each other. This completes the electric circuit between the battery 14 and the alarm 16, causing the device 16 to be activated.

Figure 2:
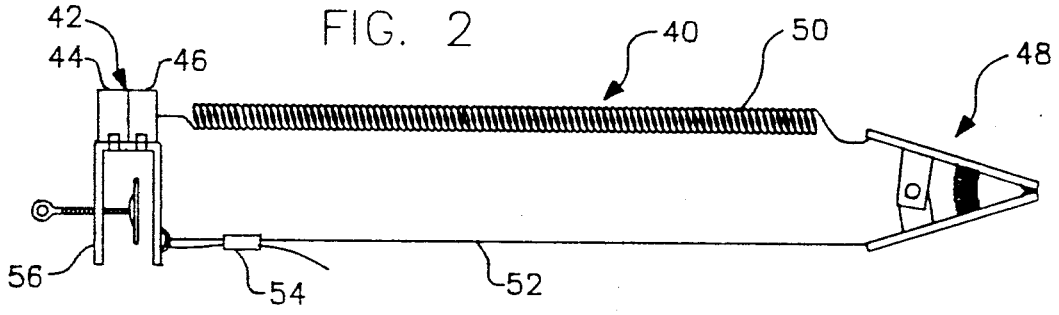
FIG. 2 is a side view of an alternative embodiment of a patient monitoring system as formed in accordance with the present invention.

FIG. 2 illustrates an alternative embodiment of the present invention, wherein the warning and message device 40 consists of a housing 42 on which is mounted a battery 44 and a prerecorded message player 46. The clip 48 is remotely positioned from the housing 42 and is electrically connected to the battery 44 and the player 46 by an electrically conductive wire 50, which may have an adjustment buckle associated with it to vary the length. Preferably, the wire 50 is coiled to maintain the wire 50 in a taut condition as the distance between the clip 48 and the housing 42 is varied. To prevent over stressing of electrical connections, a strap 52 is used to physically connect the clip 48 to the housing 42 to limit the range of movement of the patient. A buckle 54 permits adjustment in the length of the strap 52. The clip 48 has the identical structure and function as the clip 18 described above in conjunction with FIG. 1.

The housing 42 is attached to a clamp 56 that in turn can be clamped to a suitable anchor point, as discussed above. In this embodiment, the weight of the battery 44 and the player 46 is supported by the clamp 56 instead of the clip 48. If the strap 52 is not used, the maximum distance between the clip 48 and the clamp 56 will be fixed by the length of the wire 50.

Figure 3:
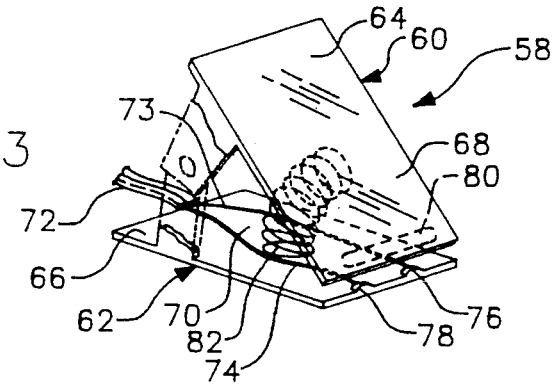
FIG. 3 is an enlarged isometric view of a clip illustrating the placement of the electrical contacts.
Figure 4:
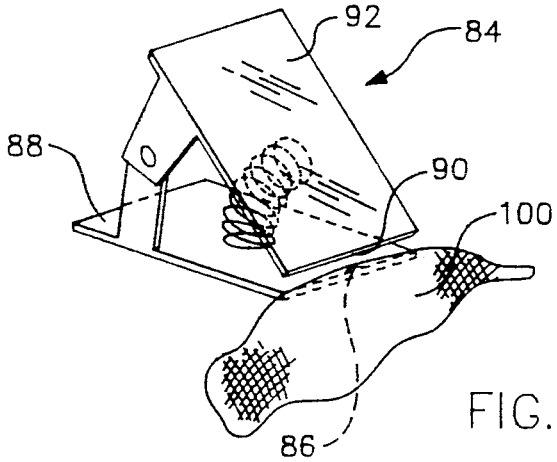
FIG. 4 is an enlarged isometric view of a clip showing an alternative placement of the electrical contacts.

FIGS. 3 and 4 illustrate alternative embodiments of clips for use in conjunction with the present invention. The clip 58 illustrated in FIG. 3 includes jaw members 60 and 62 pivotally attached to each other at their midsections. Each jaw member 60 and 62 has a handle portion 64 and 66 and a gripping portion 68 and 70, respectively. An electric cable 72 is attached to the lower jaw member 62 from which two wires 73 and 74 extended. Each wire 73 and 74 is connected to an electrical contact member 76 and 78 that is positioned at the gripping portion 70 of the lower jaw member 62. A bridge 80 formed of electrically conductive materials placed across the gripping portion 68 of the upper jaw member 60. As the helical torsion spring 82 urges the jaw members 60 and 62 to close, the bridge 80 is brought into engagement with the electrical contacts 76 and 78 to complete the electric circuit to the alarm.

FIG. 4 illustrates an alternative embodiment of a clip 84 wherein one electrical contact 86 is placed on a lower jaw member 88 and a second electrical contact 90 is placed on the upper jaw member 92. The electrical contacts 86 and 90 are in alignment so that as the lower and upper jaw members 88 and 92 close, the contacts 86 and 90 will touch to complete an electric circuit.

Figure 5:
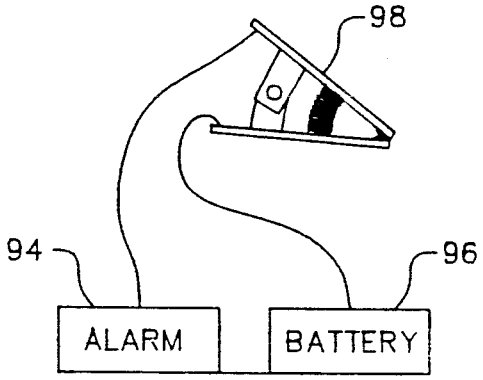
FIG. 5 is a schematic representation of an electric circut for the patient monitoring system formed in accordance with the present invention.

FIG. 5 illustrates a schematic for an electric circuit wherein the warning and message device 94 is connected in series with a battery 96 and a clip 98. The particular configuration of the clip 98 corresponds with the clip 84 illustrated and described in FIG. 4. When the clip of FIG. 3 is used, the schematic of FIG. 5 is altered to have both wires attached to only one jaw member of the clip 98.

Figure 6:
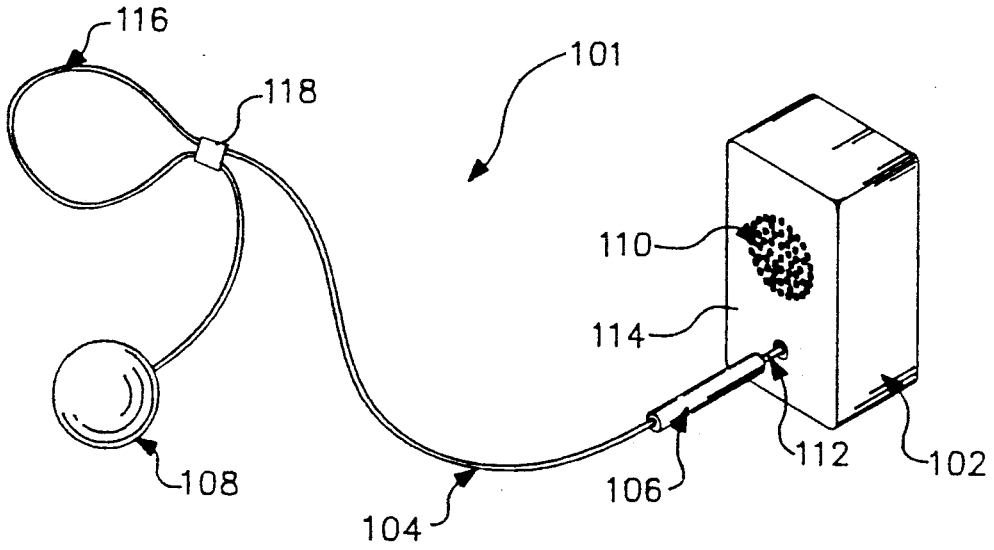
FIG. 6 is an isometric representation of an alternative embodiment of a patient monitoring system formed in accordance with the present invention.

FIG. 6 illustrates an alternative embodiment of a patient monitoring system 101. This system 101 includes an audible message device 102, a tethering means in the form of a flexible filament 104 having the first end attached to a plug 106 and a second end attached to a ball 108. The audible message device 102 includes a prerecorded voice message that is played through a speaker 110 that is designed to inform and calm a patient. The device 102 is activated when the plug 106 is removed from a receptacle 112 in the housing 114 of the device 102. Thus, when the plug 106 is inserted in the receptacle 112, the circuit controlling activation of the prerecorded audible message is open. When the plug 106 is removed from the receptacle 112, the internal circuit is completed, thus activating the audible message which is heard through the speaker 110.

The flexible filament 104 is attached to the clothing of a patient by means of the ball 108, a loop 116 of filament 104, and a retaining slide 118. The retaining slide 118 is of the well-known type that can be frictionally locked in position and released when desired. The patient's clothing is placed around the ball 108 and the loop 116 is placed over the clothing and down around the ball 108 to secure the clothing to the ball 108. The retaining slide 118 is slid towards the ball 108 to cinch the loop 116 around the ball 108. When so attached, the flexible filament 104 will cause the plug 106 to be removed from the receptacle 112 when the patient attempts to move a distance away from the audible message device 102 that is greater than the length of the flexible filament 104. When the audible message device 102 is activated, the prerecorded audible message will inform the patient that they should remain still and wait for assistance from the caregiver. In addition, the message may include information such as the patient's location and status as well as further information and instructions.

While a preferred embodiment of the invention has been illustrated and described, it is to be understood that various changes can be made therein without departing from the spirit and scope of the invention. For instance, a conventional source of electricity such as 110-volt house current can be substituted for the battery, along with a suitable circuit for rectifying and reducing the voltage to match the requirements of the alarm. Although electrical contacts 32 and 34 are used, the jaw members 24 and 26 may be partially or completely constructed of electrically conductive material, and thereby serve as the electrical contacts. In addition, the device can be attached directly to restraints. Finally, the audible message device may include a transmitter that when activated will send a signal to a remote receiver to notify and inform the caregiver. The remote receiver can be located at a central location or it can be a portable unit. Consequently, the invention is to be limited only by the scope of the claims which follow.

The embodiments of the invention in which an exclusive property or privilege is claimed are defined as follows:

1. A patient monitoring system comprising:

audible message means, including a prerecorded voice message means, that alerts a health care provider of patient movement and informs, instructs, calms, reassures, and orients a patient of his status such that the patient is informed and calmed;

a switch means for attaching to a patient's clothing and for activating said audible message means when said switch means is removed from the patient's clothing; and means for connecting said switch means to an anchor means such that movement of the patient a predetermined distance away from said anchor means causes said switch means to be removed from the patient's clothing, thereby activating said audible message means.

2. The system of claim 1, wherein said switch means comprises jaw members and said connecting means comprises an electrically conductive wire that electrically connects said jaw members to said anchor means and further connects said jaw members to said audible message means.

3. The system of claim 2, wherein said connecting means comprises a flexible filament attached at one end to said jaw members and at the other end to said anchor means.

4. The system of claim 3, wherein said flexible filament is configured to have an adjustable length.

5. The system of claim 1, wherein said switch means comprises a pair of jaw members resiliently biased to close into contact with each other to permit attachment and removal of said switch means, each of said jaw members including an electrical contact member such that when said jaw members are closed said electrical contact members engage each other to thereby activate said audible message means, and when said switch is attached to a patient's clothing and jaw members are opened and said electrical contact members are not in engagement to thereby deactivate said audible message means.

6. The system of claim 5, wherein said connecting means comprises an electrically conductive wire that electrically connects said jaw members to said anchor means and electrically connects said jaw members to said audible message means.

7. The system of claim 5, wherein said connecting means comprises a flexible filament attached at one end to said jaw members and at the other end to said anchor means.

8. The system of claim 7, wherein said flexible filament is configured to have an adjustable length.

9. An audible message system for signaling movement of persons and objects beyond a predetermined distance from an initial position, the device comprising:

an audible message means, including a prerecorded voice message means;

switch means for activating said audible message means;

anchor means for attachment to a fixed position; and means for tethering said switch means to said anchor means and for limiting movement of the objects and persons beyond the predetermined distance from the initial position, such that when the objects and persons move beyond the predetermined distance from the initial position, said tethering means causes said switch means to activate said audible message means and thereby instruct, calm, reassure, and orient the persons and inform a caregiver of movement of the objects and persons.

10. The system of claim 9, wherein said tethering means comprises electrically conductive material that electrically connects said switch means to said audible message means.

11. The system of claim 9, wherein said tethering means comprises a flexible filament attached to one end to said switch means and at the other end to said anchor means.

12. The system of claim 11, wherein said flexible filament is configured to have an adjustable length.

13. The system of claim 9, wherein said switch means comprises a receptacle associated with said audible message means and a plug slidably receivable within said receptacle and attached to said tethering means such that removal of said plug from said receptacle activates said audible message means and insertion of said plug in said receptacle deactivates said audible message means whereby movement of a patient beyond the predetermined distance from the initial position causes said tethering means to pull said plug from said receptacle and activate said audible message means.

14. The system of claim 13, wherein said tethering means comprises an electrically conductive material that electrically connects said receptacle to said audible message means.

15. A patient monitoring device for informing a health care provider of a changed patient condition and informing a patient of their condition, the device comprising:

a housing;

means for receiving a self-contained source of electrical power in said housing;

an audible message means mounted in said housing and adapted to be electrically connected to a self-contained electrical power source;

a clip mounted to said housing, said clip having a pair of jaw members resiliently biased to close together to permit attachment of said clip to a patient's clothing, said clip including a pair of electrical contacts that are adapted to be electrically connected to a self-contained electrical power source and said audible message means such that when said clip is attached to the patient's clothing, said electrical contacts are held apart to deactivate said audible message means, and when said clip is removed from the patient's clothing, said jaw members are urged to close and bring said electrical contacts into contact with each other to activate said audible message means; and means for connecting said housing to an anchor means such that movement of the patient a predetermined distance away from said anchor means causes said clip to be removed from the patient's clothing to activate said audible message means.

16. The system of claim 15, wherein said connecting means comprises a flexible filament attached at one end to said housing and at the other end to said anchor means.

17. The system of claim 16, wherein said flexible filament is configured to have an adjustable length.

18. The system of claim 17, wherein said audible message means comprises an electrically activated auditory device.

19. The system of claim 17, wherein said clip is partially contained within said housing, and further wherein at least a portion of said housing is formed of flexible material to permit squeezing of said jaw members of said clip.

20. A device for informing a caregiver of a changed condition and informing and calming a patient, the device adapted to be used in combination with a means for detecting a changed condition, the detecting means being physically connected to the patient, the device comprising:

an audible message means associated with the detecting means, said audible message means comprising a prerecorded voice message that is activated when the detecting means detects a changed condition, said prerecorded voice message further comprising a message that informs the patient of the changed condition and provides instructions and calming reassurance to the patient.

21. The system of claim 20, wherein said audible message means is further configured to inform the caregiver of a condition requiring the caregiver's attention and to describe the condition to the caregiver.

* * * * *